US005494330A

United States Patent [19]

Fotsch

[11] Patent Number: 5,494,330

[45] Date of Patent: Feb. 27, 1996

[54] SLIP COVER WITH A HOLDING TAB

[75] Inventor: Robert M. Fotsch, Mooresville, N.C.

[73] Assignee: Home Innovations, Inc., New York, N.Y.

[21] Appl. No.: 255,749

[22] Filed: Jun. 7, 1994

[51] Int. Cl.[6] ..... A47C 31/00; A47C 31/11

[52] U.S. Cl. ..... 297/229; 297/228.1; 297/219.1

[58] Field of Search ..... 297/219.11, 219.12, 297/219.1, 228.1, 229, 253

[56] References Cited

U.S. PATENT DOCUMENTS

| | | | |
|---|---|---|---|
| 1,882,485 | 10/1932 | Clements | 297/253 |
| 1,954,376 | 4/1934 | Brueckl . | |
| 1,964,242 | 6/1934 | Behrle . | |
| 1,999,560 | 4/1935 | Brueckl . | |
| 2,027,947 | 1/1936 | Wittcoff . | |
| 2,100,868 | 11/1937 | Oppenheimer, Jr. . | |
| 2,383,687 | 8/1945 | Saltz . | |
| 2,546,109 | 3/1951 | Puchalsky . | |
| 2,567,579 | 9/1951 | Russell . | |
| 2,667,211 | 1/1954 | Krasnov et al. . | |
| 3,199,916 | 8/1965 | Chiarenza . | |
| 3,653,712 | 4/1972 | Sarvas . | |
| 3,695,690 | 10/1972 | Carson . | |
| 4,969,683 | 11/1990 | Wallace et al. . | |

FOREIGN PATENT DOCUMENTS

| | | | |
|---|---|---|---|
| 1127325 | 7/1982 | Canada | 297/228.1 |

*Primary Examiner*—Peter R. Brown
*Assistant Examiner*—Anthony D. Barfield
*Attorney, Agent, or Firm*—Rogers & Killeen

[57] ABSTRACT

A protective and/or decorative cover for a seat includes a tab for holding the cover in place on the seat. The tab is attached to the cover at the juncture of the portions of the cover that drape over the backrest and the seat cushion. The tab extends downwardly between the backrest and the seat cushion and forwardly between the seat cushion and a support under the seat cushion. The cover is held in place by the weight of a person seated on the seat cushion.

11 Claims, 3 Drawing Sheets

SLIP COVER WITH A HOLDING TAB

BACKGROUND OF THE INVENTION

The present invention relates generally to protective covers for seats, and more particularly to slipcovers for chairs and sofas that include a tab for holding the slipcover in place on the chair or sofa.

A slipcover fits over a seat to protect the seat from dirt and damage and to improve its appearance. (The term "seat" refers to any piece of furniture that is designed to provide a place for a person to sit, and includes without limitation chairs, sofas, couches, love seats, lounges, etc.) A slipcover may be made to fit a seat of specific dimensions, and may include a number of fabric sheets joined to provide a custom look fit. Slipcovers may also be made in one or few sizes that fit a variety of seat sizes, and may, for example, be a single sheet of protective fabric that drapes over the seat.

Slipcovers are typically made of a pliable fabric, such as cloth of natural or synthetic fibers, plastic and the like, or a combination of fabric types that will provide some protection and desirably enhance the appearance of the seat. The type and amount of protection depend on the fabric selected.

One of the problems associated with slipcovers is that they may pull away from the seat they are covering when a person sits on the seat. Such pulling may cause the cover to fall off the seat, to gather, or to become misaligned, thereby degrading the effectiveness of the cover as well as the aesthetic appearance and comfort of the seat. For example, a person seated on the seat may slide forward in the seat and pull the slipcover forward, thereby causing the middle of the cover to become separated from the back of the seat.

One solution to this problem is to attach the top and bottom of the cover to the seat. This type of attachment may prevent the cover from falling off the seat entirely, however, it does not prevent the middle of the cover from becoming separated from the back of the seat. Further, in some custom covers it may be possible to provide permanent attachments for the sheets of fabric to each other or to the seat to reduce the tendency of the cover to pull away from the seat when a person sits on the seat. These attachments may, however, increase cost and complexity and make the cover more difficult to remove and clean.

A further solution as may be seen in FIG. 1, is to extend a portion 2 of the cover 4 between the backrest 6 and the seat cushion 8 to thereby assist in maintaining the position of the middle of the cover relative to the seat. In this arrangement, the force holding the extended portion 2 of the cover in place is limited to the pressure between the backrest 6 and the back edge of the seat cushion 8. This holding force is not normally very great and may actually decrease when a person slides forward on the seat when the force holding the cover in place should be at its peak.

The present invention recognizes that the weight of a person seated on a seat can be used to hold the cover in place and to solve the aforementioned problems. The invention provides an effective and simple solution that also does not detract from the appearance of the covered seat.

Accordingly, it is an object of the present invention to provide a novel cover for a seat that obviates the problems of the prior art and in which the weight of a person seated on a seat is used to hold the cover in place.

It is another object of the present invention to provide a novel cover for a seat that includes a tab that extends forwardly underneath a seat cushion to hold the cover in place.

It is yet another object of the present invention to provide a novel cover for a seat in which a tab holds the cover in place and in which the tab is longer than the thickness of a seat cushion.

It is a further object of the present invention to provide a novel cover for a seat in which a tab holds the cover in place and in which the tab is about one-half the length of a portion of the cover that covers a seat cushion.

These and many other objects and advantages of the present invention will be readily apparent to one skilled in the art to which the invention pertains from a perusal of the claims, the appended drawings, and the following detailed description of preferred embodiments.

DESCRIPTION OF PREFERRED EMBODIMENTS

Figure 1:
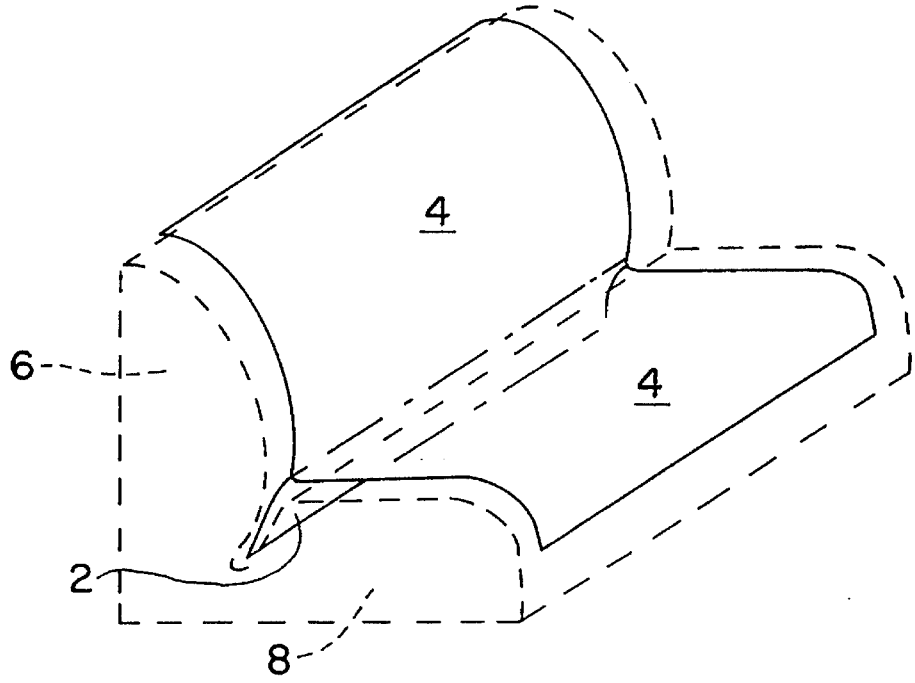
FIG. 1 (PRIOR ART)
FIG. 1 is a pictorial depiction of a cover of the prior art draped over a seat.
Figure 2:
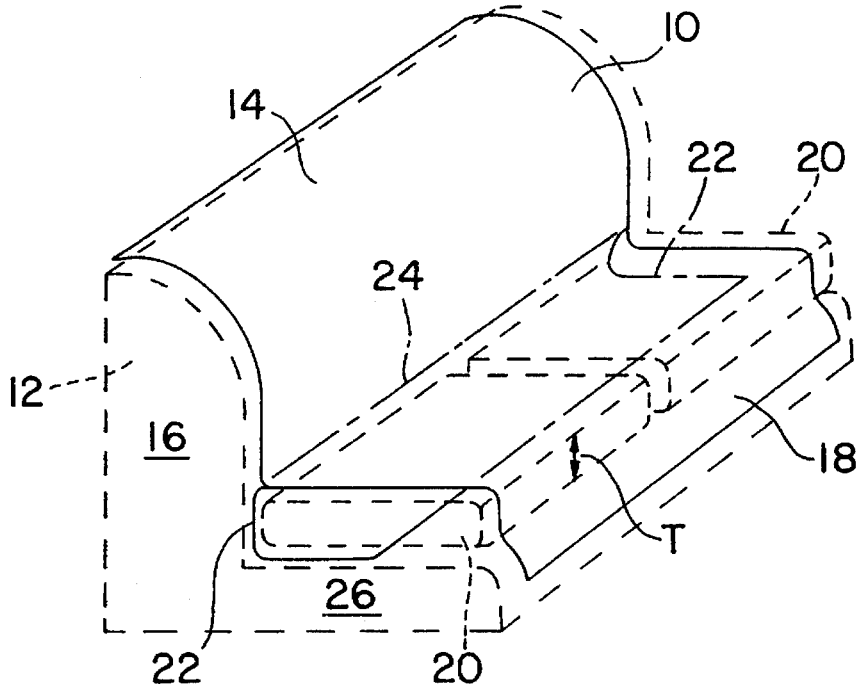
FIG. 2 is a pictorial depiction of an embodiment of a cover of the present invention draped over a seat.

With reference now to FIG. 2, a cover 10 of the present invention is depicted in solid lines on a seat 12 depicted in dashed lines. The cover 10 may be draped over the seat 12 to protect and/or enhance the appearance of the seat and may include a top portion 14 draped over the backrest 16 and a seat portion 18 draped over one or more seat cushions 20. The cover 10 includes a tab 22 that is attached to the cover 10 where the top and seat portions 14 and 18 meet (e.g., line 24). The tab 22 desirably has a length sufficient to extend downwardly between the backrest 16 and the seat cushion 20 and then forwardly between the seat cushion 20 and a seat cushion support 26. The seat cushion 20 is desirably separable from the seat cushion support 26 so that the tab 22 may be placed therebetween (the seat cushion 20 need not be completely separable, and may, for example, be attached to the seat cushion support 26 at a one side). The tab 22 may take any suitable shape (e.g., parallel sides, rounded sides, ovate, triangular, etc.) and is not limited to the shapes depicted in the figures.

When a person sits on the seat cushion 20, the weight of the person holds the tab 22 between the seat cushion 20 and the seat cushion support 26, thereby holding the cover 10 in place on the seat 12.

Figure 3:
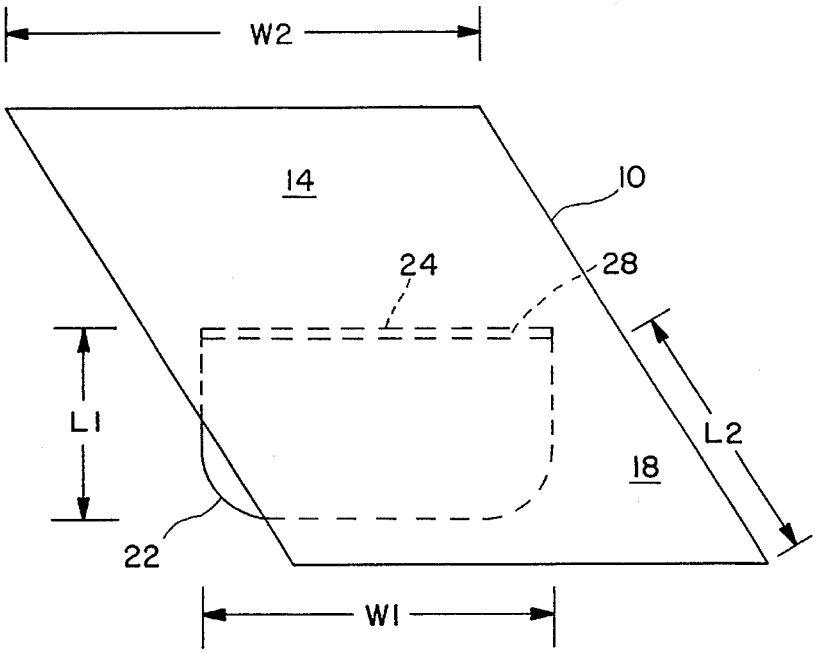
FIG. 3 is a pictorial depiction of another embodiment of the cover of the present invention.

With reference now to FIG. 3, the length L1 of the tab 22 is desirably greater than about one-half the length L2 of the seat portion 18 of the cover 10, although this distance may vary for particular seats. For covers for seats with thin seat cushions, a tab length L1 of as little as ten inches may be sufficient, while lengths of twenty inches or more may be needed for covers for seats with thicker seat cushions. As a minimum, the tab 22 should have a length L1 that is greater than the thickness T of the seat cushion 20 (see FIG. 2) so the tab 22 can extend under the seat cushion 20.

Figure 5:
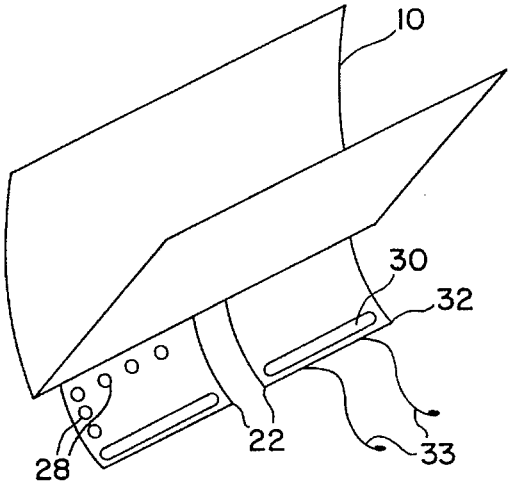
FIG. 5 is a pictorial depiction of a further embodiment of the present invention illustrating two tabs.
Figure 4:
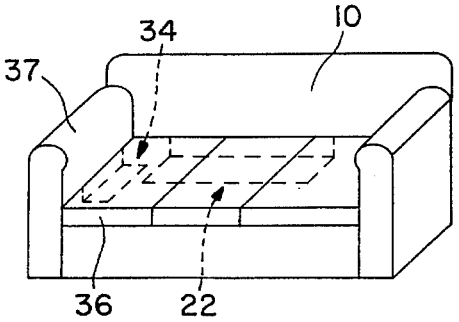
FIG. 4 is a pictorial depiction of another embodiment of the cover of the present invention custom fit for a seat with plural seat cushions.

The width W1 of the tab 22 is desirably about two-thirds the width W2 of the cover 10, although this distance may be less or more for particular seats. For example, the width W1 may be about one-half a corresponding width of a seat cushion 20 for a seat with one seat cushion. For seats with more than one seat cushion 20, the width W1 is desirably sufficient to extend under all of the seat cushions as may be seen, for example, in FIG. 4 that illustrates a custom fit slipcover 10, although this width is not required. Desirably, the tab 22 extends under at least about one-half of the outside seat cushions. By way of further example, the width W1 may be ten inches or more for chairs with a twenty to thirty inch wide cushion, W1 may be twenty inches or more for love seats with cushions totalling forty to seventy inches in width, W1 may be thirty inches or more for sofas with cushions totalling sixty to eighty inches wide, and W1 may be forty inches or more for large sofas with cushions totalling eighty to one hundred and ten inches wide. As illustrated in FIG. 5, two or more tabs may be provided; for example, one for each seat cushion.

With further reference to FIG. 3, the tab 22 may be attached to cover 10 along line 24 by conventional means, such as by sewing. The tab 22 may also be removably attached to the cover 10 with devices 28 such as zippers, snaps, VELCRO™, buttons, etc. The cover may include corresponding devices 28 for attaching the tab at selectable positions, such as the top, middle, bottom, or either side of the cover. The tab 22 may also be provided with devices 30 illustrated in FIG. 5, such as snaps or VELCRO™, for attaching an end 32 of the tab to the seat cushion or seat cushion support. The tabs 22 may be provided with strings 33 and the like for pulling the tabs into position under the seat cushion when the cover is being put onto the seat or when the tabs are misaligned.

The top portion 14 of the cover 10 may be attached to the backrest 16 and/or the seat portion 18 may be attached to the seat cushion 20 or seat cushion support 26 to assist in maintaining the position of the cover 10 relative to the seat 12. The attachments may be conventional, including by way of example VELCRO™ fasteners, buttons, zippers, ties, safety pins, snaps, glue, tacks, a sewn seam, etc.

The cover 10 may be one sheet of material or may be constructed of individual pieces of material that have been suitably joined. The references herein to top and seat portions are intended to assist in the understanding of the invention and do not imply that the invention necessarily include two separate sheets, although two or more sheets may be used without detracting from the present invention. The cover 10 may be any suitable slipcover fabric, such as discussed above.

The tab 22 may be the same material as the cover 10, or may be a material particularly adapted to withstand the chaffing between the seat cushion and the seat cushion support, or may be a material adapted to resist slipping between the seat cushion and seat cushion support, such as a rubber-coated material. The tab 22 may also be resilient to yield to seat cushion deformation without shifting position relative to the seat cushion.

The tab 22 may have one side longer than another side (such as illustrated in FIG. 5) and include devices 28 for selectively attaching the tab so that either the long or short side of the rectangular tab may be attached to the cover. The length of the tab is thus made selectable to provide the most advantageous holding force for seats of various sizes.

Referring again to FIG. 4, in an alternative embodiment of the invention, the cover 10 may include one or more side tabs 34 that extend from the side of the cover's seat portion downwardly between a seat cushion 36 and a seat armrest 37 and under the seat cushion 36. The side tabs 34 hold the cover 10 in place by preventing the cover from pulling away from the armrest 37 or from shifting sideways on the seat cushions, and may used in conjunction with the tab 22 or instead of tab 22 when, for example, the seat cushion is not separable from the seat at the rear of the seat cushion. Like tabs 22, the side tabs 34 use the weight of a seated person to keep the cover in place on the seat. Attachment devices 28 (discussed above in relation to FIG. 5) may be used so that a tab can be attached at either the side or middle of the cover to facilitate use on various types of seats. When both tabs 22 and 34 are present, they may be connected to form a receptacle for the seat cushion.

Figure 6:
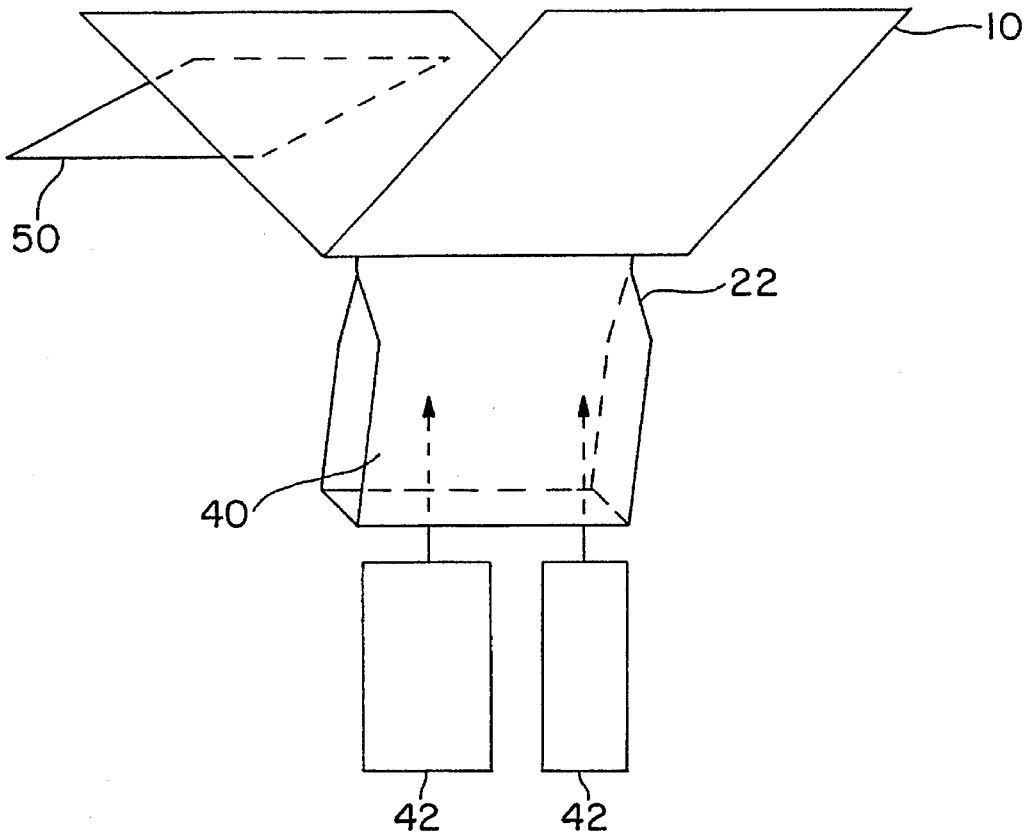
FIG. 6 is pictorial depiction of a further embodiment of the present invention illustrating a tab with a pocket for seat cushion supports.

With reference now to FIG. 6, the tabs 22 and/or 34 (not shown) may include a pocket 40 for holding one or more seat cushion supports 42. When placed under a seat cushion, the seat cushion supports 42 provide added firmness to the cushion, and to this end the supports 42 may be a suitable support material such as wooden slats, plastic sheets and the like. The pockets 40 may take a shape suitable for holding the supports 42.

Figure 7:
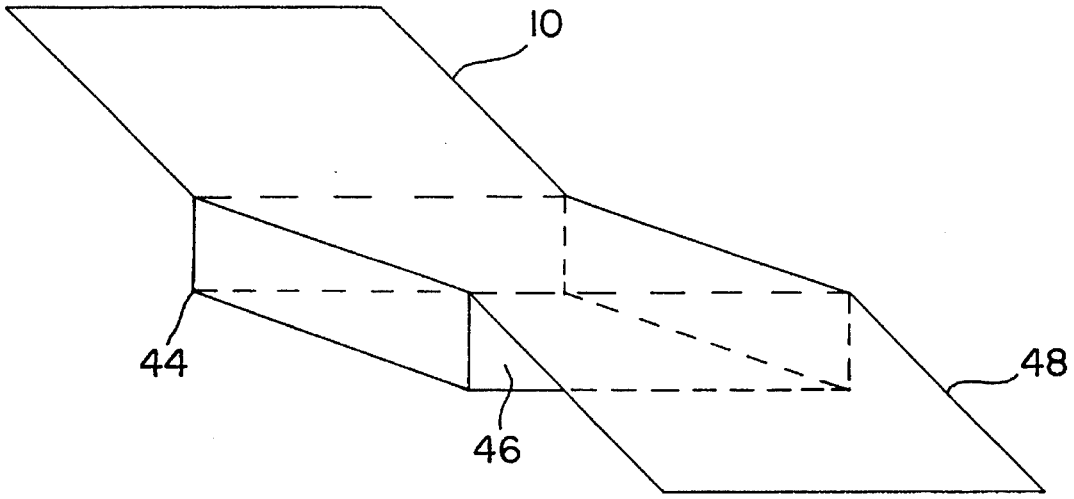
FIG. 7 is pictorial depiction of a further embodiment of the present invention illustrating a tab with a pouch for a seat cushion.

With reference to FIG. 7, a tab 44 may be attached to the cover 10 along more than one side to form a pouch 46 for a seat cushion. The pouch 46 may surround the seat cushion to hold the cushion and the cover 10 in place. The cover 10 may include a lower portion 48 that draps over the bottom portion of the front of the seat when the cover is in place. A seat cushion may be placed in the pouch 46 through an opening at either or both ends/sides of the pouch.

The tab of the present invention will find application in variety of seats and is not limited to those discussed herein. For example, the back of some seats may include a separable cushion and a tab may be placed between the back cushion and the back of the seat to hold the top of the cover in place. Such a tab 50 is illustrated in FIG. 6 and may be used in addition to the tabs 22 and/or 34 or instead of these tabs, such as in the event the seat cushion is not separable from the seat.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A seat and a removable fabric cover therefor wherein:

said seat having a backrest and a seat cushion separable from a seat cushion support; and said seat cover comprising, a top portion for covering said backrest by draping thereover from a top of said backrest to said seat cushion, a seat portion for covering said seat cushion by draping thereover from said backrest to a front of said seat cushion, said seat portion being attached to said top portion along a line that extends between the back of said seat cushion and said backrest when said cover is placed on said seat; and a tab attached along said line, said tab being dimensioned so as to extend downwardly between said backrest and said seat cushion and forwardly between said seat cushion and said seat cushion support to hold said tab between said seat cushion and said seat cushion support to thereby hold said cover in place on said seat when said tab is extended downwardly between said backrest and said seat cushion and forwardly between said seat cushion and said seat cushion support.

2. The seat and cover of claim 1 wherein said tab has a width that is greater than about one-half the width of said seat cushion.

3. The seat and cover of claim 1 wherein said tab has a length that is greater than about one-half the length of said seat cushion.

4. The seat and cover of claim 1 wherein said seat has plural of said seat cushions and wherein said tab has a width sufficient to extend under each of said plural seat cushions when said cover is placed on said seat.

5. The seat and cover of claim 1 wherein said tab has a length of about ten inches or more.

6. The cover of claim 5 wherein said tab has a length of about twenty inches or more.

7. A slipcover and a seat comprising:

said seat having a backrest and a seat cushion separable from a seat cushion support;

said slipcover with, (a) a top portion for covering said backrest by draping thereover from a top of said backrest to said seat cushion, said top portion comprising means for being removably attached to said backrest, (b) a seat portion for covering said seat cushion by draping thereover from said backrest to a front of said seat cushion, said seat portion comprising means for being removably attached to said seat cushion support, and (c) a tab attached to said slipcover and dimensioned so as to extend forwardly between said seat cushion support and said seat cushion to hold said slipcover in place on the seat, said tab having a length at least as long as the thickness of said seat cushion plus half the length of said seat cushion, wherein said tab holds said slipcover in place on said seat when said tab is extended downwardly between said backrest and said seat cushion and forwardly between said seat cushion and said seat cushion support so that said tab is held in place by pressure applied to said tab by the weight of a person seated on said seat cushion.

8. A seat and a cover therefor:

said seat comprising a backrest and a seat cushion separable from said seat;

said cover comprising a top portion for covering said backrest and a bottom portion for covering said seat cushion, and a tab attached to said cover that is so dimensioned as to extend downwardly between said seat cushion and said backrest and forwardly between said seat cushion and a portion of said seat therebeneath to hold said cover in place on said seat by using the weight of a person seated on said seat cushion to hold said tab under said seat cushion.

9. The seat and cover of claim 8 wherein said tab has a width that is greater than about one-half the width of said seat cushion.

10. The seat and cover of claim 8 wherein said tab has a length that is greater than about one-half the length of said seat cushion.

11. The seat and cover of claim 8 wherein said bottom portion is attached to said top portion along a line that extends between the back of said seat cushion and said backrest when said cover is placed on said seat, and wherein said tab is attached to said cover along said line.

* * * * *